US009826814B2

(12) United States Patent
Baudin et al.

(10) Patent No.: US 9,826,814 B2
(45) Date of Patent: Nov. 28, 2017

(54) DEVICE FOR PACKAGING AND APPLYING A SOLID COSMETIC PRODUCT

(71) Applicant: L'OREAL, Paris (FR)

(72) Inventors: Gilles Baudin, Montigny-les-Cormeilles (FR); Kristell Le Moing, Paris (FR)

(73) Assignee: L'OREAL, Paris (FR)

( * ) Notice: Subject to any disclaimer, the term of this patent is extended or adjusted under 35 U.S.C. 154(b) by 441 days.

(21) Appl. No.: 14/346,511

(22) PCT Filed: Sep. 18, 2012

(86) PCT No.: PCT/EP2012/068375

§ 371 (c)(1),
(2) Date: Mar. 21, 2014

(87) PCT Pub. No.: WO2013/041536

PCT Pub. Date: Mar. 28, 2013

(65) Prior Publication Data

US 2014/0227018 A1 Aug. 14, 2014

(30) Foreign Application Priority Data

Sep. 23, 2011 (FR) ..... 11 58520

(51) Int. Cl.
*A45D 40/04* (2006.01)
*A45D 40/00* (2006.01)
*A45D 34/04* (2006.01)

(52) U.S. Cl.
CPC ..... *A45D 40/00* (2013.01); *A45D 34/04* (2013.01); *A45D 40/04* (2013.01); *A45D 2200/055* (2013.01)

(58) Field of Classification Search
CPC ..... A45D 40/04
(Continued)

(56) References Cited

U.S. PATENT DOCUMENTS 3,792,068 A 2/1974 Luedders et al.
5,547,302 A * 8/1996 Dornbusch ..... A45D 40/04 401/172

(Continued)

FOREIGN PATENT DOCUMENTS

DE 102008012457 A1 12/2008
EP 0813829 A1 12/1997

(Continued)

OTHER PUBLICATIONS

International Search Report for PCT/EP2012/068375.
English language Abstract for FR 2845578.

*Primary Examiner* — David Walczak
*Assistant Examiner* — Joshua Wiljanen
(74) *Attorney, Agent, or Firm* — The Marbury Law Group, PLLC

(57) ABSTRACT

The invention relates to a device for packaging a cosmetic product (P) in solid form and applying it to the skin, having a longitudinal axis X, comprising: a sleeve (70) containing the cosmetic product (P), an elevator means (50) able to support the cosmetic product (P) at a current position in the sleeve and to axially move the cosmetic product along the axis X to make it emerge from the sleeve (70) bypassing through the orifices (77), a means (60) for manually actuating the elevator, a means (80) for partial covering of the outlet of the sleeve (70) comprising a vault (71) formed solely of an elastically deformable material.

20 Claims, 7 Drawing Sheets

Figure 1:
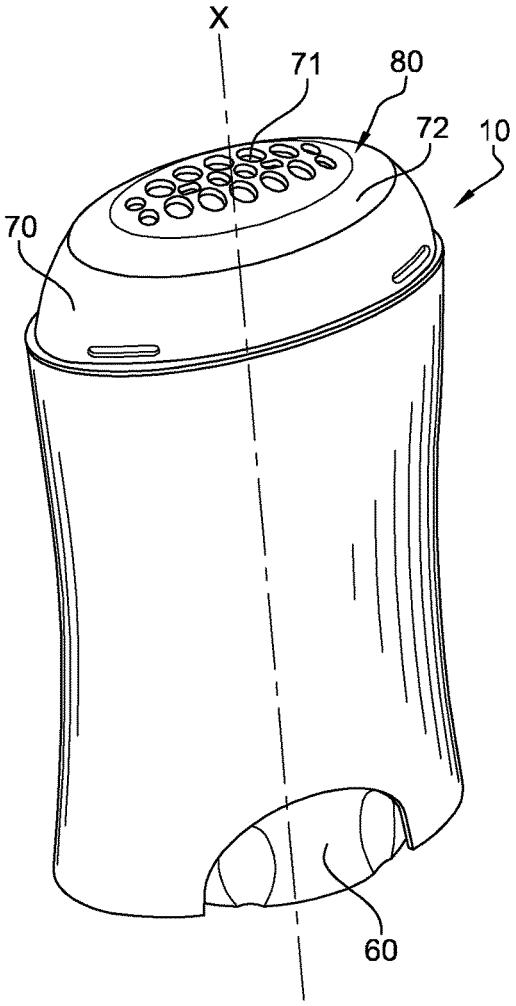

(58) Field of Classification Search
USPC ..... 401/266
See application file for complete search history.

(56) References Cited

U.S. PATENT DOCUMENTS

| | | | | |
|---|---|---|---|---|
| 5,868,510 | A | 2/1999 | Lacout et al. | |
| 6,116,803 | A | 9/2000 | Szekely et al. | |
| 6,196,747 | B1 | 3/2001 | Kreiseder et al. | |
| 6,336,763 | B1 * | 1/2002 | Losier | A45D 40/04 401/205 |
| 6,340,258 | B2 | 1/2002 | Gueret | |
| 6,572,300 | B2 | 6/2003 | Altonen et al. | |
| 6,649,173 | B1 | 11/2003 | Arnaud et al. | |
| 7,374,360 | B1 | 5/2008 | Szekely | |
| 8,342,764 | B2 | 1/2013 | Bonneyrat | |
| 2001/0003564 | A1 | 6/2001 | Gueret | |
| 2004/0213626 | A1 | 10/2004 | Ramet | |
| 2009/0028625 | A1 | 1/2009 | Bonneyrat | |
| 2010/0183536 | A1 | 7/2010 | Ansmann et al. | |
| 2010/0189665 | A1 | 7/2010 | Dierker et al. | |
| 2010/0189673 | A1 | 7/2010 | Jackwerth et al. | |
| 2010/0247588 | A1 | 9/2010 | Hloucha et al. | |
| 2010/0311627 | A1 | 12/2010 | Hloucha et al. | |
| 2011/0059032 | A1 | 3/2011 | Dierker et al. | |
| 2011/0142778 | A1 | 6/2011 | Hloucha et al. | |
| 2013/0149272 | A1 | 6/2013 | Hloucha et al. | |

FOREIGN PATENT DOCUMENTS

| | | | |
|---|---|---|---|
| EP | 0847752 | A1 | 6/1998 |
| EP | 0970635 | A1 | 1/2000 |
| EP | 1428455 | A1 | 6/2004 |
| EP | 2022365 | A1 | 2/2009 |
| FR | 2845578 | A1 | 4/2004 |
| WO | 9603899 | A1 | 2/1996 |
| WO | 9851185 | A1 | 11/1998 |
| WO | 0180684 | A2 | 11/2001 |

* cited by examiner

A-A

B-B

DEVICE FOR PACKAGING AND APPLYING A SOLID COSMETIC PRODUCT

This is a national stage application of PCT/EP2012/068375, filed internationally on Sep. 18, 2012, which claims priority to French Application No. 1158520, filed Sep. 23, 2011.

The invention relates in general to devices for packaging and applying cosmetic products in the form of solids, especially deodorants or antiperspirants.

The term "cosmetic product" is understood for example, for the purposes of the present invention, to mean a product as defined in Council Directive 93/35/EEC dated 14 Jun. 1993.

The term "antiperspirant" means any substance which has the effect of reducing the flow of sweat and/or of reducing the sensation of moisture associated with human sweat, and/or of masking human sweat.

The term "deodorant active agent" means any substance that is capable of masking, absorbing, improving and/or reducing the unpleasant odour resulting from the decomposition of human sweat by bacteria.

More specifically, the invention relates to a device for packaging and applying a cosmetic product in solid form, of the type comprising:

- a sleeve (70) containing the cosmetic product (P),
- a means for partial covering of the outlet of the sleeve, such as a perforated dome,
- an elevator means able to support the cosmetic product at a current position in the sleeve and to axially move the cosmetic product along the axis X from its current position in the direction of the perforated dome to make the product emerge from the sleeve,
- a means for manually actuating the elevator.

Such devices are known for example from documents U.S. Pat. Nos. 6,196,747, 7,374,360, 6,572,300 or FR 2 845 578.

EP 772 410 describes a device in which the perforated dome is a metal or plastic material that is moulded as a single part. It comprises regularly or uniformly spaced orifices having various shapes, dimensions or densities. By way of illustration, the perforated dome may constitute a grid, for example made of metal, polyethylene or polypropylene. The elevator means may comprise an elevator platform and an elevator screw engaged with the elevator platform by threading. The manual actuating means may comprise a rotatable thumbwheel in order to turn the elevator screw.

However, this device is not entirely satisfactory since the lack of deformation of the dome prevents an easy movement or a sliding without snagging of the latter over a surface such as the skin. The dome may even cause discomfort on the skin during the movement or sliding of the device over the skin.

Moreover, the pressure of the product on the rigid metal or plastic perforated dome causes an exudation of the solid cosmetic product.

The user may observe phase separation of the stick into a generally oily, liquid phase and a solid phase that is drier than the original stick. The appearance of the product is damaged thereby, as are its quality and its effectiveness. This phenomenon is particularly significant for certain formulae.

EP 980 218 describes a solid antiperspirant stick packaged in a device as described previously, in which the perforated dome comprises a plurality of openings covering between 15% and 80% of the total surface area of the perforated dome. The high proportion of openings in the dome aims to reduce the excess pressure during the exudation and the phase separation.

However, even by respecting this proportion of opening, there remains a phase separation and an evaporation of the volatile raw materials and solvents.

EP 1 276 401 also describes a solid antiperspirant stick packaged in an applicator device. The dome comprises a first material and a second material made from thermoplastic elastomers, the second material being more rigid than the first and providing a structural support for the first material.

Nevertheless, with such a device, the phenomenon of exudation remains since the stick is solid and sensitive to this phenomenon.

There is a need to find applicators for dispensing solid sticks without exudation.

The invention must also respond to the problems customarily faced for applicators of this type, namely:

- to provide a product application device that comprises a product outlet mechanism that is simple to produce and to use;
- to provide an application device that is not very cumbersome while avoiding the risks of damaging the product;
- to provide an application device that does not allow the outflow of the product in the closed position of the device.

To solve these problems, the invention proposes a device as described above, the dome of which is produced with particular materials while respecting a particular structure.

Thus, one subject of the invention is a device for packaging a cosmetic product in solid form and applying it to the skin, having a longitudinal axis X, comprising:

- a sleeve containing the cosmetic product,
- an elevator means able to support the cosmetic product at a current position in the sleeve and to axially move the cosmetic product along the axis X to make it emerge from the sleeve by passing through the orifices,
- a means for manually actuating the elevator,
- a means for partial covering of the outlet of the sleeve comprising:
  - a vault made of a first elastically deformable material perforated by through-orifices, and
  - a means for supporting the vault made of a second material, the vault comprising an outer surface able to be brought into contact with the skin and an inner surface able to be brought into contact with the solid cosmetic product before it passes through the orifices, characterized in that the vault and the means for supporting the vault are configured so that more than 60% of the inner surface of the vault with respect to its total surface is able to come into contact with the solid cosmetic product before it passes through the orifices, preferably more than 75%, more advantageously more than 95% and more advantageously still 100%.

Against all expectations, it is possible, by suitably selecting the constituent materials of the dome, to respond to the problems stated above. Thus, according to the invention, the choice of the material becomes essential. The amount of orifices passing through the dome is no longer the only means of limiting the exudation. It even becomes possible to produce devices that have few orifices but in which the stick does not phase separate.

This embodiment goes against the teaching of the prior art, which encourages increasing the amount of orifices.

Nevertheless, according to the invention, the choice of the materials for the dome must be accompanied by a particular structure in order to support and strengthen the vault. On the contrary, the prior art does not encourage such a structural support.

The invention may be carried out with any known type of mechanism for a solid stick applicator comprising an elevator system as described above, for example those described in EP 1 276 401, EP 772 410, FR 2 845 578, EP 980 218, EP 2 022 365, EP 970 635, EP 1 428 455, EP 813 829. In particular, the elevator system may comprise a screw, ratchet, piston or spring system.

The expression "composition in solid form" is understood, for the purposes of the present invention, to mean any composition having a hardness measured at 32° C. under a humidity of 40% ranging from 5 kPa to 150 kPa, and preferably ranging from 20 kPa to 100 kPa.

The hardness is defined as the maximum stress force $F_{max}$ measured by texturometry during the penetration of a cylindrical probe into the sample of formulation, assessed under precise measurement conditions as follows.

The formulae are poured hot into jars 9 cm in diameter and 3 cm deep (i.e.: "Favorit Soft" jars from RPC Bramlage GmbH). Cooling is performed at room temperature. The hardness of the formulae produced is measured after an interval of 24 hours. The jars containing the samples are characterized by texturometry using a texturometer such as the TA-XT2 machine sold by the company Rheo, according to the following protocol:

At a temperature of 32° C. and at a relative humidity of 40%, a cylindrical stainless-steel probe with a spindle 2 mm in diameter is brought into contact with the sample at a speed of 1 mm/sec. The measurement system detects the interface with the sample, with a detection threshold equal to 0.005 newtons. The probe penetrates 0.3 mm into the sample, at a speed of 0.1 mm/s. The measuring machine records the change in force measured in compression over time, during the penetration phase. The hardness of the sample corresponds to the average of the maximum force values detected during penetration, over at least three measurements. After a measurement, the relaxation time is 1 second, and the probe is withdrawn at a speed of 1 mm/sec.

The hardness of the composition is calculated via the following equation:

$$\text{hardness} = \frac{F_{max}}{\text{Surface area of the cylinder}}$$

The solid composition according to the invention may especially be a "soft solid" composition containing at least one oily phase comprising:

a) at least one solid fatty substance, b) at least one oil.

According to one particular form, the compositions are anhydrous. The term "anhydrous composition" means a composition containing less than 2% by weight of water, indeed even less than 0.5% of water, and especially devoid of water, the water not being added during the preparation of the composition but corresponding to the residual water contributed by the mixed ingredients.

According to another particular form, the compositions of the invention may also comprise at least one aqueous phase, and may especially be chosen from O/W or W/O emulsions or a W/O/W or O/W/O multiple emulsion.

Oily Phase

The compositions according to the invention advantageously contain at least one water-immiscible organic liquid phase, known as an oily phase. This phase generally comprises one or more hydrophobic compounds that make said phase water-immiscible. Said phase is liquid (in the absence of structuring agent) at room temperature (20-25° C.). Preferentially, the water-immiscible organic liquid phase in accordance with the invention generally comprises at least a volatile or non-volatile non-silicone oil and/or a non-volatile silicone oil.

The term "oil" means a fatty substance that is liquid at room temperature (25° C.) and atmospheric pressure (760 mmHg, i.e. 105 Pa). The oil may be volatile or non-volatile.

For the purposes of the invention, the term "volatile oil" means an oil that is capable of evaporating on contact with the skin or the keratin fibre in less than one hour, at room temperature and atmospheric pressure. The volatile oils of the invention are volatile cosmetic oils, which are liquid at room temperature, having a non-zero vapour pressure, at room temperature and atmospheric pressure, ranging in particular from 0.13 Pa to 40 000 Pa ($10^{-3}$ to 300 mmHg), in particular ranging from 1.3 Pa to 13 000 Pa (0.01 to 100 mmHg), and more particularly ranging from 1.3 Pa to 1300 Pa (0.01 to 10 mmHg).

The term "non-volatile oil" means an oil that remains on the skin or the keratin fibre at room temperature and atmospheric pressure for at least several hours, and that especially has a vapour pressure of less than $10^{-3}$ mmHg (0.13 Pa).

The oils in accordance with the invention are preferably chosen from any cosmetically acceptable oil, especially mineral, animal, plant or synthetic oils, especially hydrocarbon-based oils, fluoro oils or silicone oils, or mixtures thereof.

The term "hydrocarbon-based oil" means an oil mainly containing carbon and hydrogen atoms and possibly one or more functions chosen from hydroxyl, ester, ether and carboxylic functions. Generally, the oil has a viscosity of from 0.5 to 100 000 mPa·s, preferably from 50 to 50 000 mPa·s and more preferably from 100 to 300 000 mPa·s.

The term "silicone oil" means an oil comprising in its structure carbon atoms and at least one silicon atom.

The term "fluoro oil" means partially hydrocarbon-based and/or silicone-based oils comprising carbon atoms and fluorine atoms.

As examples of volatile hydrocarbon-based oils that may be used in the invention, mention may be made of:

- volatile hydrocarbon-based oils chosen from hydrocarbon-based oils containing from 8 to 16 carbon atoms, and especially $C_8$-$C_{16}$ isoalkanes of petroleum origin (also known as isoparaffins), for instance isododecane (also known as 2,2,4,4,6-pentamethylheptane), isodecane and isohexadecane, for example the oils sold under the trade names Isopar or Permethyl, branched $C_8$-$C_{16}$ esters and isohexyl neopentanoate, and mixtures thereof. Other volatile hydrocarbon-based oils, for instance petroleum distillates, especially those sold under the name Shell Solt by the company Shell, may also be used; volatile linear alkanes, such as those described in Patent Application DE10 2008 012 457 from the company Cognis.

As examples of non-volatile hydrocarbon-based oils that may be used in the invention, mention may be made of:

- hydrocarbon-based oils of animal origin, such as perhydrosqualene;
- hydrocarbon-based plant oils such as liquid triglycerides of fatty acids having 4 to 24 carbon atoms, for instance heptanoic or octanoic acid triglycerides, or wheatgerm oil, olive oil, sweet almond oil, palm oil, rapeseed oil, cottonseed oil, alfalfa oil, poppy oil, pumpkin oil, marrow oil, blackcurrant oil, evening primrose oil, millet oil, barley oil, quinoa oil, rye oil, safflower oil, candlenut oil, passion flower oil, musk rose oil, sunflower oil, corn oil, soybean oil, grapeseed oil, sesame seed oil, hazelnut oil, apricot oil, macadamia oil, castor oil, avocado oil, caprylic/capric acid triglycerides, for instance those sold by the company Stéarineries Dubois or those sold under the names Miglyol 810, 812 and 818 by the company Dynamit Nobel, jojoba oil and shea butter oil;

linear or branched hydrocarbons, of mineral or synthetic origin, such as liquid paraffins and derivatives thereof, petroleum jelly, polydecenes, polybutenes, hydrogenated polyisobutene such as Parleam, or squalane;

synthetic ethers containing from 10 to 40 carbon atoms;

synthetic esters, especially of fatty acids, for instance the oils of formula $R_1COOR_2$ in which $R_1$ represents a linear or branched higher fatty acid residue containing from 1 to 40 carbon atoms and $R_2$ represents a hydrocarbon-based chain, which is especially branched, containing from 1 to 40 carbon atoms, with $R_1+R_2 \geq 10$, for instance purcellin oil (cetostearyl octanoate), isononyl isononanoate, isopropyl myristate, isopropyl palmitate, $C_{12}$-$C_{15}$ alcohol benzoates, hexyl laurate, diisopropyl adipate, isononyl isononanoate, 2-ethylhexyl palmitate, 2-octyldodecyl stearate, 2-octyldodecyl erucate, isostearyl isostearate or tridecyl trimellitate; alcohol or polyalcohol octanoates, decanoates or ricinoleates, for instance propylene glycol dioctanoate; hydroxylated esters, for instance isostearyl lactate, octyl hydroxystearate, octyldodecyl hydroxystearate, diisostearyl malate, triisocetyl citrate, and fatty alcohol heptanoates, octanoates or decanoates; polyol esters, for instance propylene glycol dioctanoate, neopentyl glycol diheptanoate or diethylene glycol diisononanoate; and pentaerythritol esters, for instance pentaerythrityl tetraisostearate;

fatty alcohols that are liquid at room temperature, containing a branched and/or unsaturated carbon chain containing from 12 to 26 carbon atoms, for instance octyldodecanol, isostearyl alcohol, 2-butyloctanol, 2-hexyldecanol, 2-undecylpentadecanol or oleyl alcohol;

higher fatty acids such as oleic acid, linoleic acid or linolenic acid;

carbonates;

acetates;

citrates.

As examples of partially hydrocarbon-based and/or silicone-based fluoro oils, mention may be made of fluorosilicone oils, fluorinated polyethers and fluorosilicones as described in document EP-A-847 752.

As examples of non-volatile silicone oils, mention may be made of linear or cyclic non-volatile polydimethylsiloxanes (PDMSs); polydimethylsiloxanes comprising alkyl, alkoxy or phenyl groups, which are pendant or at the end of a silicone chain, these groups containing from 2 to 24 carbon atoms; phenyl silicones, for instance phenyl trimethicones, phenyl dimethicones, phenyltrimethylsiloxydiphenylsiloxanes, diphenyl dimethicones, diphenylmethyldiphenyltrisiloxanes and 2-phenylethyl trimethylsiloxysilicates, and mixtures thereof.

According to one particularly preferred form of the invention, the compositions contain less than 2% volatile silicone oil, or even less than 0.5% volatile silicone oil, and are especially free of volatile silicone oil; the volatile silicone oil not being added during the preparation of the composition, but corresponding to the residual volatile silicone oil introduced by the mixed ingredients.

Solid Fatty Substances

The composition according to the invention comprises at least one solid fatty substance preferably chosen from waxes and pasty fatty substances, and mixtures thereof, and more particularly waxes.

Pasty Fatty Substances

For the purposes of the present invention, the term "pasty fatty substance" (also known as pasty fatty substance) means a lipophilic fatty compound with a reversible solid/liquid change of state, exhibiting an anisotropic crystalline organization in the solid state, and comprising, at a temperature of 23° C., a liquid fraction and a solid fraction.

According to one preferred embodiment, the composition according to the invention comprises at least one wax.

The wax under consideration in the context of the present invention is generally a lipophilic compound that is solid at room temperature (25° C.), with a solid/liquid reversible change of state, having a melting point of greater than or equal to 30° C., which may range up to 200° C. and in particular up to 120° C.

In particular, the waxes that are suitable for the invention may have a melting point of greater than or equal to 45° C. and in particular of greater than or equal to 55° C.

The waxes that may be used in the compositions according to the invention are chosen from waxes that are solid at room temperature, of animal, plant, mineral or synthetic origin, and mixtures thereof.

Examples that may be mentioned include the following hydrocarbon-based waxes comprising a fatty alkyl chain generally containing from 10 to 60 carbon atoms and preferably from 20 to 40 carbon atoms, said chain possibly being saturated or unsaturated, substituted or unsubstituted, and linear, branched or cyclic, preferably saturated and linear:

fatty alcohols;

fatty alcohol esters;

fatty acids;

fatty acid amides;

fatty acid esters including triglycerides;

fatty acid ethers;

ethoxylated fatty alcohols;

ethoxylated fatty acids and the corresponding salts thereof.

Among the fatty alcohols, mention may be made of stearyl alcohol and cetearyl alcohol, or mixtures thereof.

Among the fatty alcohol esters, mention may be made of triisostearyl citrate, ethylene glycol bis(12-hydroxystearate), tristearyl citrate, stearyl octanoate, stearyl heptanoate, trilauryl citrate, and mixtures thereof.

Among the fatty acid esters, mention may be made of ester waxes, monoglycerides, diglycerides and triglycerides.

Ester waxes that may be mentioned include stearyl stearate, stearyl behenate, stearyloctyldodecanol, cetearyl behenate, behenyl behenate, ethylene glycol distearate and ethylene glycol dipalmitate. Use may be made in particular of a $C_{20}$-$C_{40}$ alkyl (hydroxystearyloxy)stearate (the alkyl group containing from 20 to 40 carbon atoms), alone or as a mixture. Such a wax is especially sold under the names "Kester Wax K 82 P®", "Hydroxypolyester K 82 P®" and "Kester Wax K 80 P®" by the company Koster Keunen.

Among the triglyceride waxes, mention may be made more particularly of tribehenin, $C_{18}$-$C_{36}$ triglycerides, and mixtures thereof.

Antiperspirant Salts or Complexes

The aluminium and/or zirconium antiperspirant salts or complexes are preferably chosen from aluminium halohydrates; aluminium zirconium halohydrates, complexes of zirconium hydroxychloride and of aluminium hydroxychloride with or without an amino acid, such as those described in U.S. Pat. No. 3,792,068.

Among the aluminium salts, mention may be made in particular of aluminium chlorohydrate in activated or unactivated form, aluminium chlorohydrex, the aluminium chlorohydrex-polyethylene glycol complex, the aluminium chlorohydrex-propylene glycol complex, aluminium dichlorohydrate, the aluminium dichlorohydrex-polyethylene glycol complex, the aluminium dichlorohydrex-propylene glycol complex, aluminium sesquichlorohydrate, the aluminium sesquichlorohydrex-polyethylene glycol complex, the aluminium sesquichlorohydrex-propylene glycol complex, aluminium sulfate buffered with sodium aluminium lactate.

Among the aluminium-zirconium salts, mention may be made in particular of aluminium zirconium octachlorohydrate, aluminium zirconium pentachlorohydrate, aluminium zirconium tetrachlorohydrate and aluminium zirconium trichlorohydrate.

The complexes of zirconium hydroxychloride and of aluminium hydroxychloride with an amino acid are generally known as ZAG (when the amino acid is glycine). Among these products, mention may be made of the aluminium zirconium octachlorohydrex-glycine complexes, the aluminium zirconium pentachlorohydrex-glycine complexes, the aluminium zirconium tetrachlorohydrex-glycine complexes and the aluminium zirconium trichlorohydrex-glycine complexes.

The aluminium and/or zirconium antiperspirant salts or complexes may be present in the composition according to the invention in a proportion of at least 0.5% by weight and preferably from 0.5% to 25% by weight relative to the total weight of the composition.

Deodorant Active Agents

The compositions according to the invention may also furthermore contain one or more additional deodorant active agents.

The term "deodorant active agent" refers to any substance that is capable of masking, absorbing, improving and/or reducing the unpleasant odour resulting from the decomposition of human sweat by bacteria.

The deodorant active agents may be bacteriostatic agents or bactericides that act on underarm odour microorganisms, such as 2,4,4'-trichloro-2'-hydroxydiphenyl ether (® Triclosan), 2,4-dichloro-2'-hydroxydiphenyl ether, 3',4',5'-trichlorosalicylanilide, 1-(3',4'-dichlorophenyl)-3-(4'-chlorophenyl)urea (® Triclocarban) or 3,7,11-trimethyldodeca-2,5,10-trienol (® Farnesol); quaternary ammonium salts such as cetyltrimethylammonium salts, cetylpyridinium salts, DPTA (1,3-diaminopropanetetraacetic acid), 1,2-decanediol (Symclariol from the company Symrise), glycerol derivatives, for instance caprylic/capric glycerides (Capmul MCM from Abitec), glyceryl caprylate or caprate (Dermosoft GMCY and Dermosoft GMC, respectively from Straetmans), polyglyceryl-2 caprate (Dermosoft DGMC from Straetmans), and biguanide derivatives, for instance polyhexamethylene biguanide salts,—chlorhexidine and salts thereof; 4-phenyl-4,4-dimethyl-2-butanol (Symdeo MPP from Symrise).

Among the deodorant active agents in accordance with the invention, mention may also be made of—zinc salts, for instance zinc salicylate, zinc gluconate, zinc pidolate; zinc sulfate, zinc chloride, zinc lactate, zinc phenolsulfonate; zinc ricinoleate;

sodium bicarbonate;

salicylic acid and derivatives thereof such as 5-n-octanoylsalicylic acid;

zeolites, especially silver-free metallic zeolites;

alum.

The deodorant active agents may preferably be present in the compositions according to the invention in weight concentrations ranging from 0.01% to 10% by weight relative to the total weight of the composition.

Additives

The compositions according to the invention may also furthermore comprise additional cosmetic and dermatological active agents.

The cosmetic compositions according to the invention may comprise cosmetic adjuvants chosen from opacifiers, stabilizers, preserving agents, polymers, fragrances, thickeners, dermatological or cosmetic active agents, colorants or any other ingredient usually used in cosmetics for this type of application.

Needless to say, a person skilled in the art will take care to select this or these optional additional compounds such that the advantageous properties intrinsically associated with the cosmetic composition in accordance with the invention are not, or are not substantially, adversely affected by the envisaged addition(s).

Advantageously, the vault and the means for supporting the vault are configured to be in contact with one another only at the periphery of the vault. In this case there is no support structure placed underneath the vault.

Thus, the vault deforms and comes into contact with the solid stick. In this particular embodiment, there is no material interposed between the vault and the solid stick.

Preferably, the first material is made of an elastomer. This type of material has the ideal qualities of flexibility and elasticity that are required for this type of applicator.

More preferably, the second material is able to flex elastically during the application of the stick to the skin. Thus, the creation of angular edges and of sharp zones is avoided.

The second material may also be a multilayer material, especially a two-layer material.

More advantageously still, the first and second materials are firmly attached to each other by bi-injection moulding. This process is simple and economical.

The second material may be chosen from polyethylene, polypropylene, a mixture of polyethylene and polypropylene, a polyester, a natural or synthetic rubber, a latex, TPE (thermoplastic elastomer), a Kraton polymer, silicone, Santoprene®, SEBS® and SBS®.

By using two types of material, the less deformable material may support the one which is less so and give the vault the desired deformability.

More advantageously, the partial covering means comprises a means of attachment to the outlet of the sleeve.

This means may be formed by one of the constituent materials of the covering means itself. It may also be a complementary structure onto which this means is pushed.

Preferably, the outer surface area of the elastically deformable material represents more than 50%, preferably more than 75%, and more preferably still more than 95% of the surface area of the covering means able to come into contact with the skin.

Preferably, the partial covering means has an outward deflection value under the application of a 500 gram load ranging from 0.3 millimetre to 3 millimetres, preferably from 0.5 millimetre to 2.5 millimetres, and more preferably from 0.8 millimetre to 2 millimetres.

With such values, the partial covering means deforms under the pressure of the solid composition. However, this deformation is reversible and does not damage the formula.

More preferably, the partial covering means has an inward deflection value under the application of a 500 gram load ranging from 1.5 millimetres to 7 millimetres, preferably from 1 millimetre to 6 millimetres, and more preferably from 2 millimetres to 5.5 millimetres.

With such values, the covering means deforms under the pressure of the device against the user's skin. However, this deformation is reversible as soon as the user releases this pressure. At the time of this pressure, the excess of product leaves the device.

More advantageously still, the surface area of the orifices represents between 0.1% and 15% of the total surface area of the vault and preferably between 0.2% and 10% of the total surface area of the vault.

The invention will be understood better from reading the following description and with reference to the accompanying figures. The latter are only presented by way of non-limiting indication of the invention.

Figure 2:
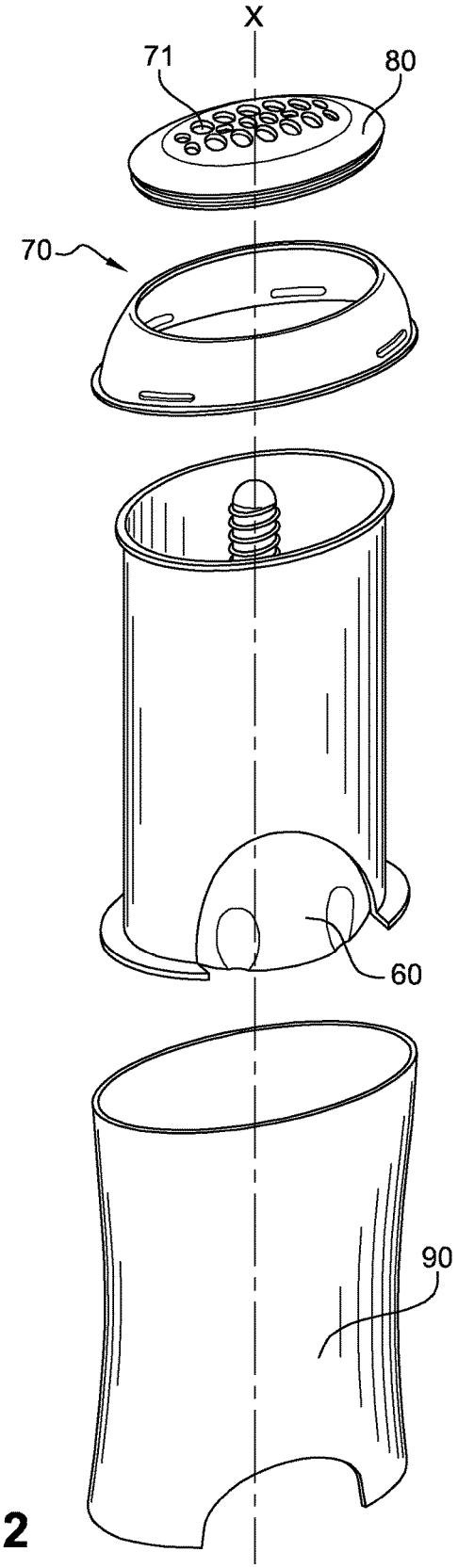
Figure 3:
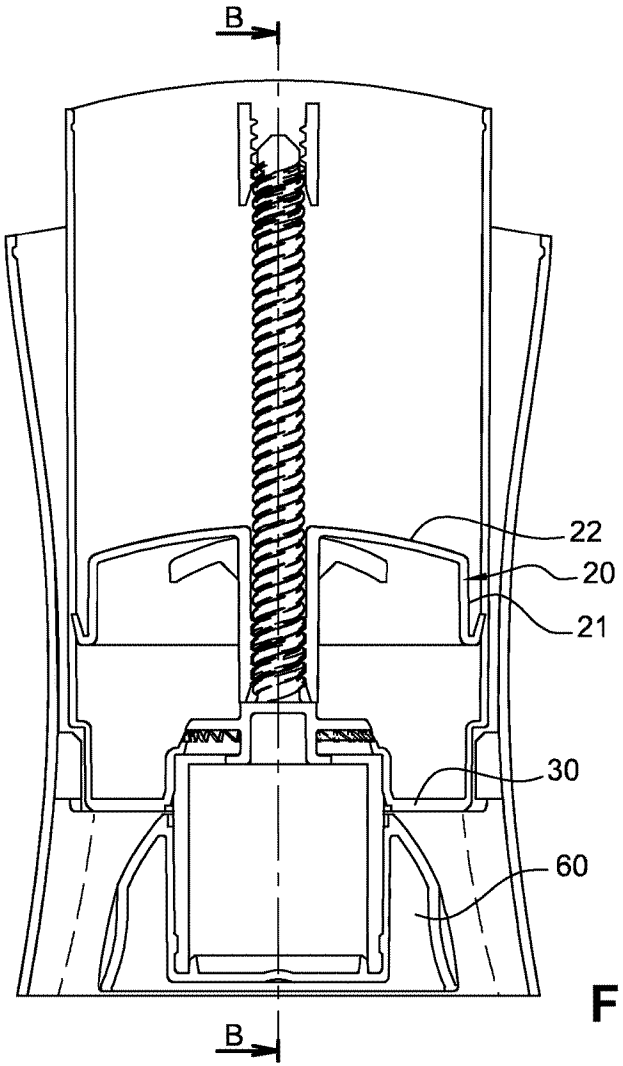
Figure 4:
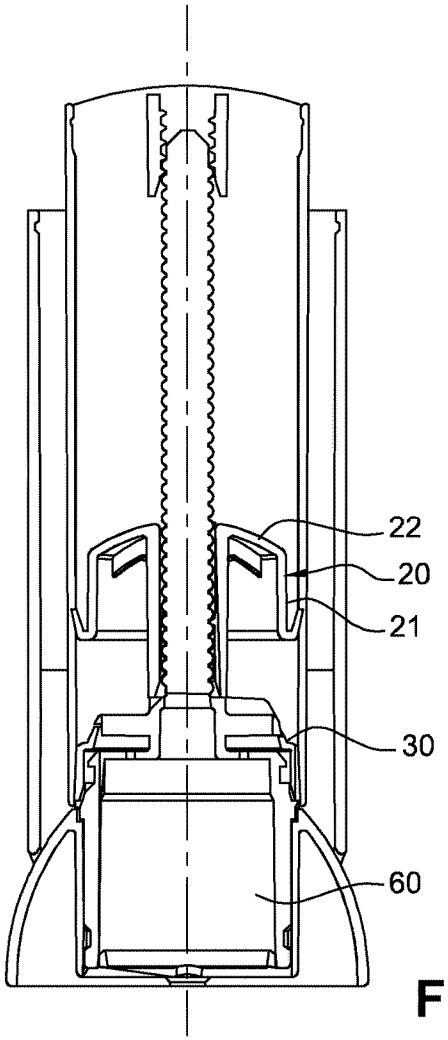
Figure 5:
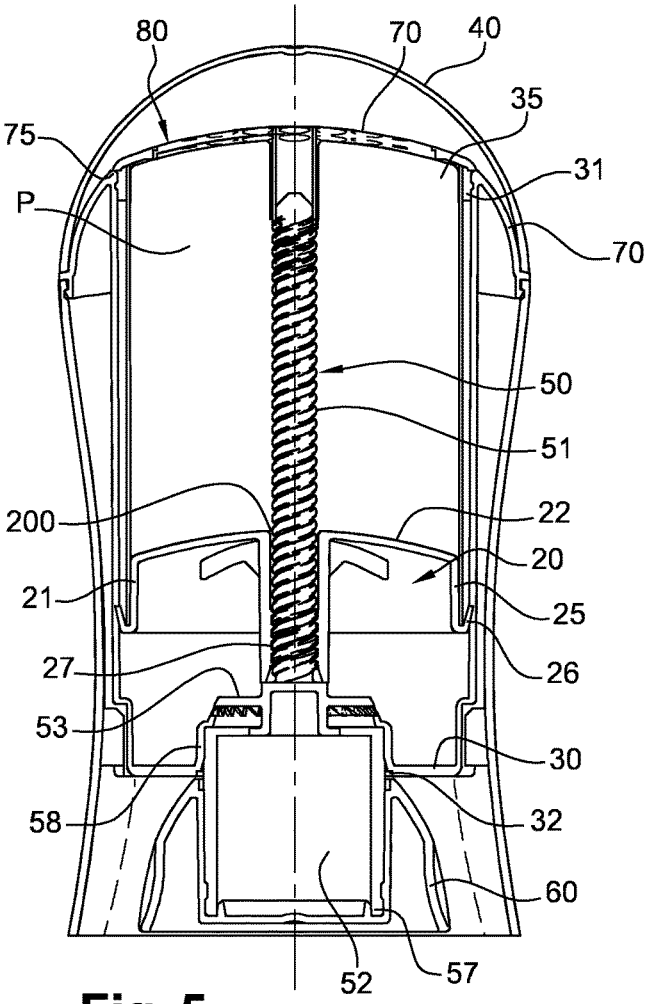
Figure 6:
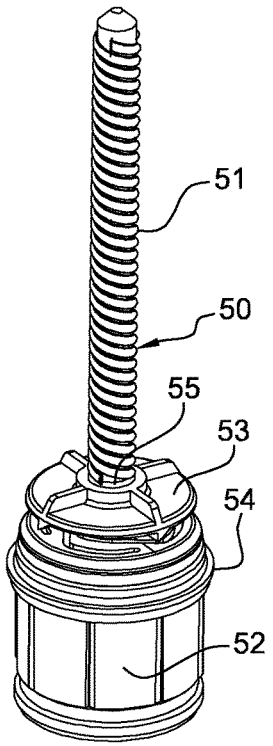
Figure 7:
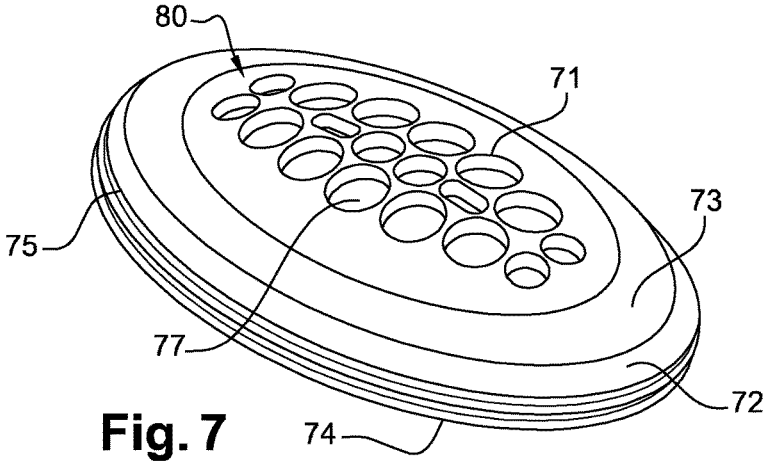
Figure 8:
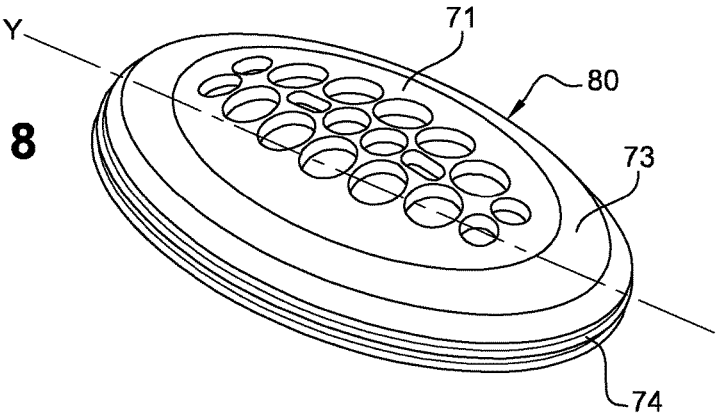
Figure 9:
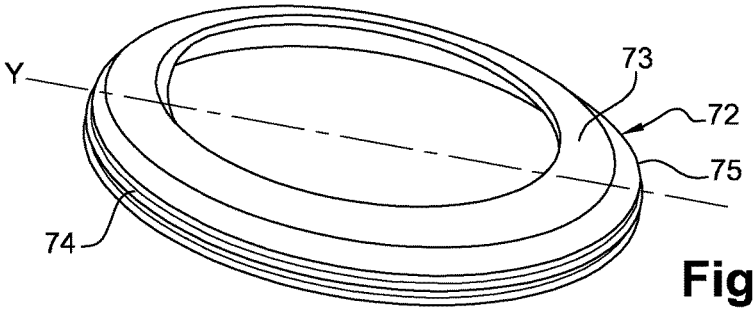
Figure 10:
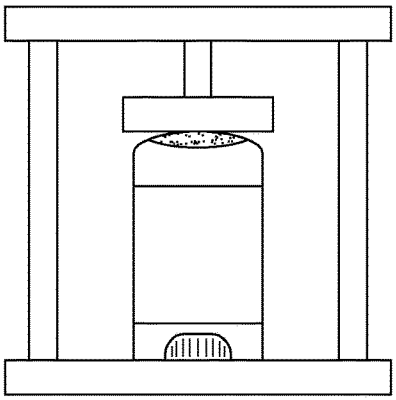
Figure 11:
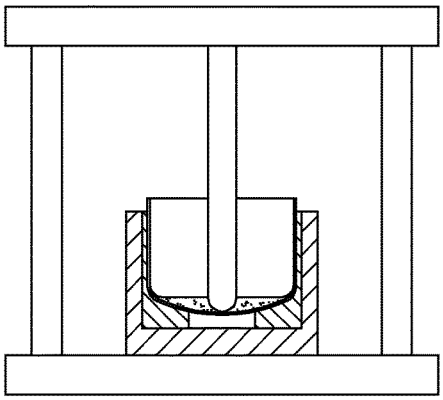
Figure 12:
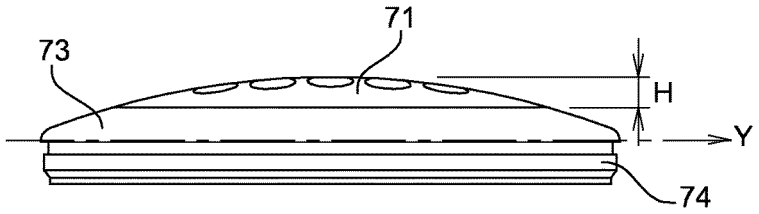
Figure 13:
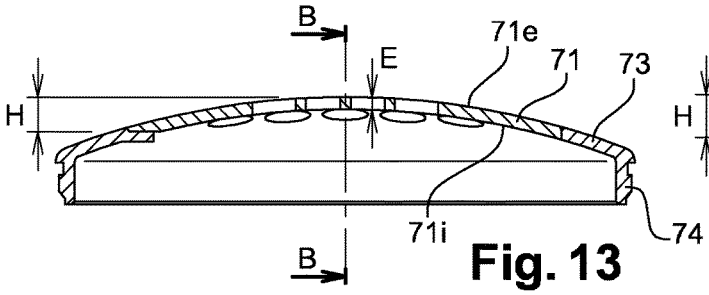
Figure 15:
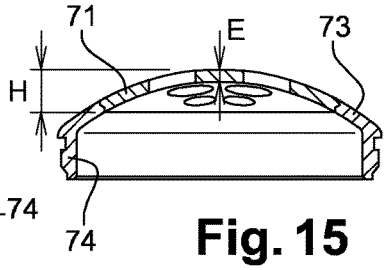
Figure 14:
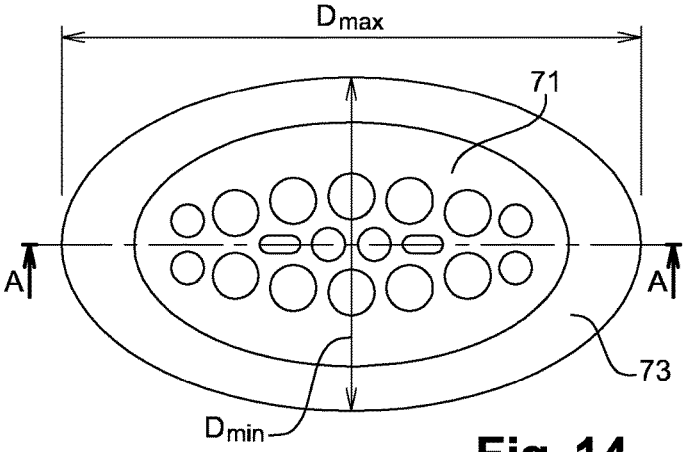
Figure 16:
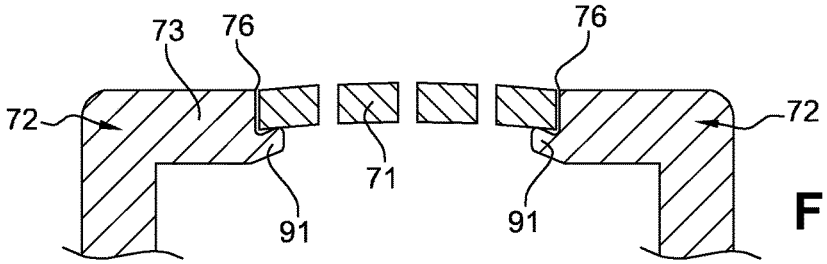
Figure 17:
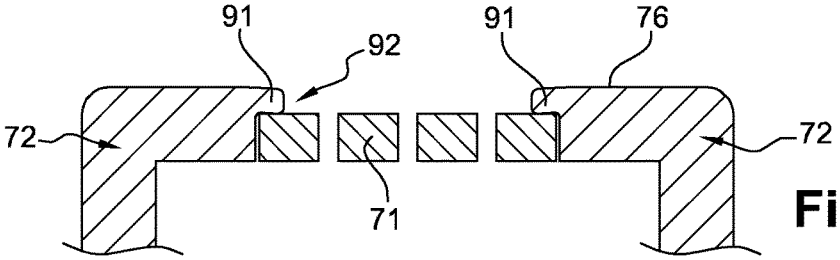
Figure 18:
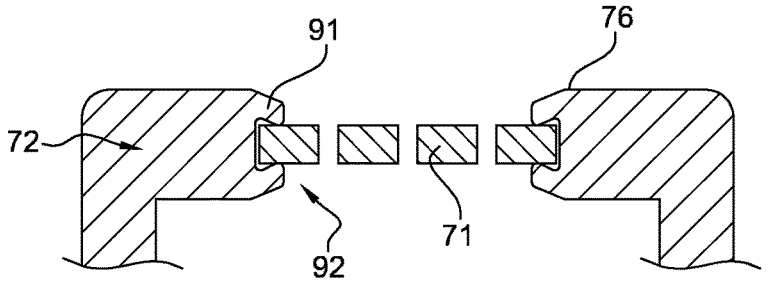
Figure 19:
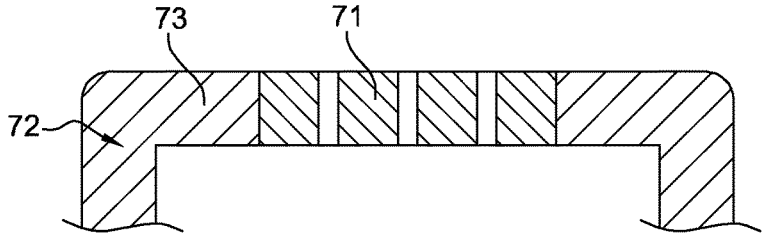
Figure 20:
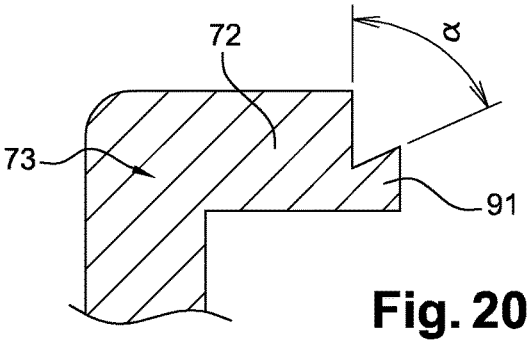
Figure 21:
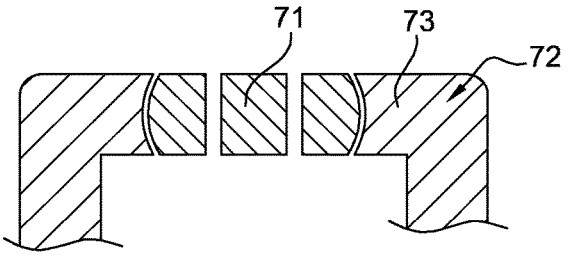
Figure 22:
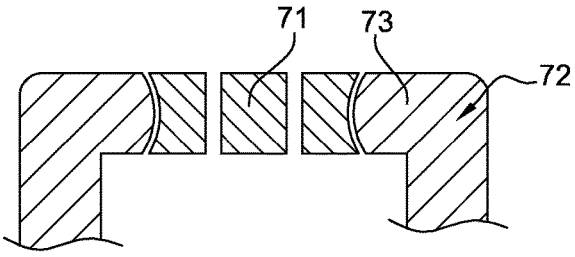
Figure 24:
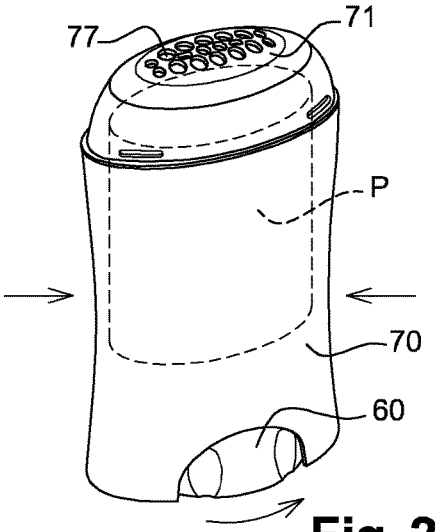
Figure 25:
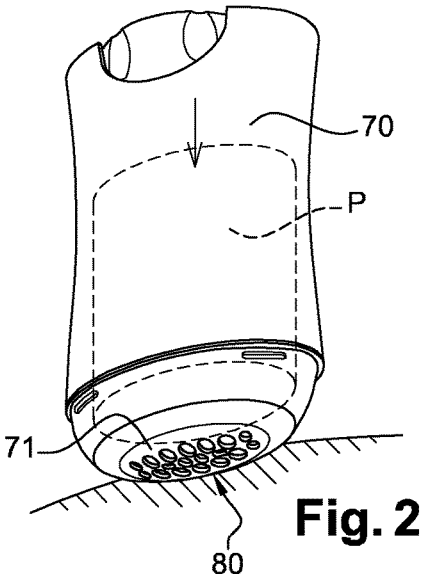
Figure 26:
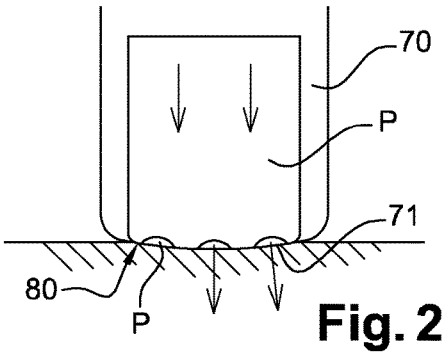
Figure 27:
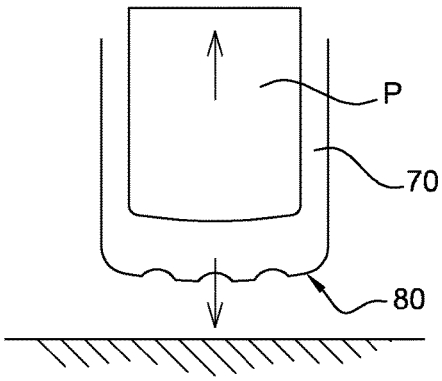

In the figures:

FIG. 1: a perspective view of a device according to the invention,

FIG. 2: an exploded perspective view of a device according to the invention, FIG. 3: a front longitudinal cross-sectional view of a device according to the invention, sleeve not represented, FIG. 4: a side longitudinal cross-sectional view of a device according to the invention, sleeve not represented, FIG. 5: a front longitudinal cross-sectional view of a device according to the invention, FIG. 6: perspective view of the elevator means, support removed, FIG. 7: perspective view of the covering means, FIG. 8: perspective view of the covering means, FIG. 9: device for measuring the outward deflection value, FIG. 10: device for measuring the inward deflection value, FIG. 11: perspective view along the cross section AA of the covering means with marking of the height H, FIG. 12: perspective view along the cross section AA of the covering means with marking of the cross section BB, FIG. 13: top view of the covering means, FIG. 14: section of the covering means along cross section BB, FIGS. 15 to 17: front longitudinal cross-sectional view along the X axis of various types of attachment means between the vault and the structure, FIG. 18: front longitudinal cross-sectional view along the X axis of a fitting by force between the vault and the structure, FIG. 19: determination of the crown angle with the attachment means, FIGS. 20 to 22: front longitudinal cross-sectional view along the X axis of various forms of the vault 71 in the structure 72 that are fitted by force, FIGS. 22 to 25: various positions of the device during the use thereof, FIGS. 26 to 27: various views of the device during the use thereof.

Represented in FIGS. 1 to 5 is an example of an application device 1 according to the invention. The application device 1 is for example intended for the application of a cosmetic product, in particular a deodorant product, that is in the form of a solid stick.

The device 1 comprises a longitudinal axis X and an elliptical transverse cross section. The transverse cross section of elliptical shape makes it possible in particular to allow only a translational movement between the sleeve and the support. It is quite obvious that any other non-circular shape may have this function. Alternatively, the transverse cross section may be circular and an anti-rotation system may be provided on the support and the sleeve, such as for example a pin that slides in an axial groove. Of course, the device may also have a circular transverse cross section.

The device 1 comprises a support 20 bearing the cosmetic product in solid form. The support 20 is positioned in the sleeve 70. The support 20 cooperates with a threaded screw 50 in order to move along the axis X.

The support 20 is a hollow body formed by a side wall 21 that extends parallel to the axis X. The side wall 21 is closed at its upper end by a transverse wall 22. It comprises a first radially outward projection 25, in the vicinity of its lower end. This first projection 25 may serve as a lower stop for the sleeve 70. A second radially outward projection 26, larger than the first one, is provided underneath the first one. The wall 22 comprises a central orifice 200 having a diameter adjusted to that of the threaded rod screw 50. The lips 25 and 26 are used for the positioning and the sealing of the piston with the inside of the sleeve 70.

A hollow cylinder 27 equipped with an internal thread is positioned against the wall 22 inside the hollow body. This cylinder 27 is positioned in the extension of a central orifice 200 located at the centre of the wall 22. The cylinder 27 may be moulded as a single part with the support 20 or be attached to this support.

The sleeve 70 has a transverse cross section substantially larger than that of the wall 21 of the support 20. It is open at both of its ends, the upper end 31 delimiting an opening 35 allowing the passage of the product P and the positioning of the sleeve 60. The lower end of the sleeve 70 comprises a shoulder 32 directed towards the centre of the sleeve 70.

The screw 50 comprises the threaded rod 51 and a screw head 52. The screw head 52 is coaxial with the axis X. It has a circular cross section, but the cross section could be, in certain embodiments, square, rectangular, oval, etc. It has the shape of a hollow cylinder open at one end and finishing at the other end with snap-fastening tabs 58. These tabs 58 are snap-fastened in a removable manner to corresponding tabs positioned at one end of the rod 51. A washer 53 is positioned at the end 55 of the threaded rod 51, in the vicinity of the snap-fastening tabs, in order to consolidate the connection between the head 52 and the rod 51. The washer 53 is used for the non-detachable assembling of the screw to the body.

The screw head 52 comprises a flange 54. This flange is used to forcibly fit the head 52 in a base 60 of frustoconical shape. This base 60 can be actuated by the user. To facilitate this actuation, it may comprise ribs or other reliefs. The screw head 52 is fastened to the sleeve 70 by force-fitting, snap-fastening or screwing for example.

At the end opposite the screw head 52, the sleeve 70 finishes with a sleeve head moulded as one part with the sleeve or fastened to the sleeve 70, for example by force-fitting, snap-fastening or screwing for example. The sleeve 70 has the general shape of a cylinder of axis X, having a circular transverse cross section, opening at both its ends. The first of these ends is connected to a dome. The inner lateral surface of the sleeve has an outer annular bead to limit the axial translation of the dome during movement of the applicator over the skin.

The dome 80 partially closes the outlet of the sleeve 70. It comprises a central vault 71 supported by a support structure 72.

The support structure 72 comprises a crown 73 mounted on a skirt 74. The crown 73 and the skirt 74 are separated by a shoulder 75 having an orientation substantially perpendicular to the axis X. The shoulder 75 butts up axially against a corresponding relief formed in the free end of the sleeve 70.

The central vault 71 is substantially flat and transverse. It comprises through-orifices 77 arranged over three lines. These orifices 77 have a circular transverse cross section. They may also form slots. They could also have a transverse cross section that is square, rectangular, ellipitical or of any other shape. Similarly, instead of being arranged over two lines, they could have a random distribution or form any other pattern such as a triangle or a zig zag. Several orifice shapes may be used for the invention. A dome may for example have orifices of square transverse cross section and others of circular transverse cross section.

The skirt 74 extends, from the vault 71, from the shoulder 75. The skirt 74 has the shape of a cylinder, the outer diameter of which is slightly less than the inner diameter of the neck of the sleeve so that, after snapping of the dome 80 onto the sleeve 70, the outer lateral surface of the skirt 74 is in leaktight contact with the inner lateral surface of the neck of the sleeve.

Preferably, the free end of the skirt 74 may have a bevel facilitating the introduction of the sealing skirt into the sleeve 70.

As represented in FIGS. 7, 8, 11, 12, 13 and 14, the applicator head has the shape of a dome 80. The support structure 72 forms an application element holder. The vault 71 has the shape of an oblique plate having a longitudinal axis Y and a height H.

Advantageously, the height H of the vault is between 0.1 millimetre and 8 millimetres, preferably between 1 millimetre and 5 millimetres, and more advantageously between 1.5 and 4 millimetres.

The thickness E of the vault 71, measured at its centre of gravity, and representing the thickness of the constituent material of the dome at this point is advantageously between 0.8 millimetre and 4 millimetres, and preferably between 1 millimetre and 2 millimetres.

More generally, the dome may have the shape of a plate that is circular, square, rectangular, triangular, parallelepipedal or of any other shape, which is more or less curved.

Preferably, the maximum dimension $d_{max}$ of the vault and the minimum dimension $d_{min}$ of the vault are such that $d_{max}/d_{min}$ is between 1 and 5, preferably between 1.5 and 3.

The vault 71 forms a connecting part linking the edges of the crown 73. This vault 71 is curved upwards between the edges of the crown, and has an intrados 71*i* or concave face and an extrados 71*e* on the opposite side.

The intrados 71*i* is able to come into contact with the solid stick positioned inside the sleeve 70. The originality of the invention lies in particular in the fact that the entire surface area of the intrados comes into contact with the solid stick. In particular, according to the invention, there is no grid or mesh positioned between the intrados and the stick. Therefore, the user benefits from an application that is smooth and easy to handle, with no exudation of the stick.

The extrados 71*e* comes into direct contact with the surface to be treated, in particular in contact with the skin of the user. There is no layer of plastic material belonging to the device and positioned on the extrados.

Advantageously, the constituent material of the vault 71 is an elastically deformable material. In particular, it may be chosen from thermoplastic or crosslinked elastomers, especially EPDM, natural rubbers, and nitrile, butyl or silicone elastomers. In the case of a crosslinked elastomer, the manufacture of the vault 71 takes place in a compression mould, heated to the appropriate temperature.

The vault 71 may be made from a first, elastically deformable, material. The support structure 72 supporting the vault 71 is made from a second material, different from the first. The vault 71 and the structure 72 are firmly attached to each other, in particular by bi-injection moulding. For this purpose, in particular in the case of bi-injection moulding, use will preferably be made of two physico-chemically compatible materials.

The second material is preferably constituted of a polyolefin, in particular of a polypropylene or a polyethylene.

According to the invention, the vault may be fastened to the structure 72 by any means.

In the vicinity of its periphery, the vault 71 finishes with an inner edge 76, the cross section of which may or may not be reduced with respect to the average cross section of the vault, and that forms the vault 71 itself. The inner edges of the crown may comprise means for attaching the vault 71, for example a solid bead, thus ensuring the immobilization of the vault in mounted position on the sleeve.

The difference in resistance, during the introduction and during the extraction, may be obtained by configuring the attachment means so that they are effaced, at least partly, during the introduction of the vault 71 into the structure 72, in response to an axial force exerted on the vault. The introduction of the vault is therefore easy. On the other hand, after having cleared the neck of the structure 72, the attachment means 79 spread out radially so as to oppose the removal of the vault when an axial tension is exerted above. Thus, the functions "ease of assembly" and "solid attachment" are very satisfactorily fulfilled, without having to penalize one at the expense of the other. Advantageously, a perfect connection of the surfaces 70, 71 and 72 is achieved so as not to injure the consumer when using the device.

Various attachment means 79 may be envisaged, for example, they may be constituted of at least one lip extending, continuously or discontinuously, along the inner edge 76 of the crown, and a first end of which is attached to the vault along a joining zone, a second end of the lip being free and, in the absence of strain, turned in the direction of the second end, said lip 91 forming, with the crown 73 an acute, non-zero (FIG. 14) or zero (FIG. 15) angle. FIG. 17 shows the case where the vault is inserted between two lips 91.

Preferably, said angle is between 30° and 60°, and more preferably between 35° and 55°, and more preferably still around 45°. Such an angle is chosen in particular as a function of the material forming the attachment means, and as a function of the desired solidity of the attachment. The position of this angle is indicated in FIG. 18.

Preferably, the joining zone between the lip 91 and the vault is positioned at a non-zero distance from the skirt 74. Thus, the crown defines, above the joining zone, a lip portion that makes it possible to position the vault in the opening delimited by the attachment means before exerting the axial force aimed at inserting it completely.

The vault 71, in its part intended to be in the joining zone 92, i.e. between the upper edge of 71 and the attachment means 79, may have an outer diameter such that it is lightly gripped inside the neck of the opening of the crown. Sealing is necessary between 75 and 70.

For the case of the force fitting of the vault 71 into the structure 72, the inner edges of the crown and of the vault may have various complementary shapes, as represented for example in FIGS. 20 to 22.

Determination of the Total Surface Area Able to be Positioned in Contact with the Skin The total surface area (S) able to be positioned in contact with the skin is formed by the surface area of the central vault 71 and the surface area of the crown 73. Indeed, when the user applies the device to the skin, these surface areas are actually in contact with the skin, naturally, without effort. This surface area (S) may be flat. It may also be slightly curved in order to facilitate the application.

The total surface area (S) is the total surface area of the vault and the total surface area of the crown limited by the transverse plane in which the sum of these two surface areas is maximal.

Determination of the Inward Deflection Value During Application of a 500 Gram Load As represented in FIG. 9, in order to determine this value, the device according to the invention is placed on a table, the base 60 resting on this table. The cosmetic product (P) is removed from the sleeve 70. A 500 gram load is applied to the dome 80. The flattening of the dome is measured as follows:

A measurement axis is placed parallel to the axis X of the applicator. The origin of this axis is located at the intersection of the latter with the table. The parameters are noted as follows:

$x_o$: position of the peak of the dome with no load, $x_{500}$: position of the peak of the dome with a 500 gram load.

The inward deflection is equal to $x_o - x_{500}$.

Determination of the Outward Deflection Value During Application of a 500 Gram Load As represented in FIG. 10, in order to determine this value, the sleeve covered with the dome 80 is placed in a support. The support is placed on a table. The dome is positioned facing the table. The sleeve is held fixed in this support while being raised relative to the bottom of the support by 5 centimetres. It is for example possible to choose, as the support, a hollow cylinder, the diameter of which may hold the sleeve. One end of the cylinder may be closed. A 500 gram load is applied to the inside of the dome 80. The stretching of the dome is measured as follows:

A measurement axis is placed parallel to the axis X of the applicator. The origin of this axis is located at the intersection of the latter with the table. The parameters are noted as follows:

$x_o$: position of the peak of the dome with no load, $x_{500}$: position of the peak of the dome with a 500 gram load.

The outward deflection is equal to $x_o - x_{500}$.

The method of operation of the device is illustrated in FIGS. 22 to 25.

Figure 23:
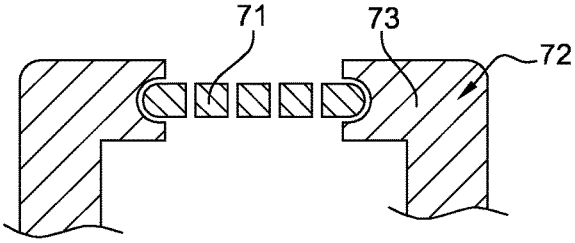

In order to use the device, the user grasps it by the sleeve 70. The user turns the thumbwheel 60 to make the solid stick P come at least in contact with the inner face of the vault 71 (FIG. 22), and optionally in contact with the outer face. The user orients the sleeve 70 so that the outer surface of the vault 71 comes against the surface of skin to be treated (FIG. 23). The user presses lightly on the vault 71 by exerting an axial pressure.

The vault 71 deforms elastically toward the inside of the sleeve. The axial deformation gives rise to a pressure on the stick P. The solid stick is forced longitudinally through the orifices 77 and arrives in contact with the skin (FIG. 24).

The user continues the application by moving the vault 71 over the skin, while exerting a light pressure on this vault along the axis X. The internal volume of the sleeve 70 continues to decrease. An additional pressure is exerted on the product P. It is again forced to move towards the outlet of the sleeve 70. The stick P passes through the orifices 77. It is deposited on the skin.

When the user wishes to cease the application, he or she releases the pressure on the vault 71 (FIG. 25). The dome 80 is put back in place, by heading in the opposite direction to the stick P. The inner surface of the vault 71 lifts off from the stick P. The dome 80 returns to its rest position. The stick P is no longer subjected to the pressure of the dome 80. It does not exude and there is no phase separation of its formula.

Examples Of Solid Compositions

| Ingredient | Ex 1 | Ex 2 |
|---|---|---|
| Wax (1) | 7.5% | 10% |
| Antiperspirant (3) | 20% | 20% |
| Aerogel VM-2270 | 2% | 2% |
| Oil (2) | q.s. for 100 | q.s. for 100 |
| Aerosil R972 | — | — |
| Hardness (kPa) | 26 | 65 |
| Appearance | Fondant solid | Fondant solid |
| Feel | Soft and dry | Soft and dry |

(1) Tribehenin/$C_{18-36}$ Triglyceride mixture (6%/1.5% by weight)

(2) Dimethicone 10 cSt/Polydecene/Dimethicone and Dimethicone Crosspolymer (DC 9041 from Dow Corning)/PPG-14 butyl ether mixture (39.7%/26.3%/2%/2% by weight)

(3) Aluminium/zirconium glycine tetrahydroxychloride complex

% by weight relative to the total weight of the composition

The invention claimed is:

1. A device for packaging a solid cosmetic product and applying it to the skin, having a longitudinal axis, said device comprising:

a sleeve containing the solid cosmetic product;

an elevator means configured to support the solid cosmetic product at a position in the sleeve and to axially move the cosmetic product along the axis to make it emerge from the sleeve by passing through orifices;

a means for manually actuating the elevator means;

a means for partial covering of the outlet of the sleeve comprising:

a vault made of a first elastically deformable material perforated by through-orifices, and a means for supporting the vault made of a second material;

wherein the vault comprises (i) an outer surface configured to contact the skin, and (ii) an inner surface configured to contact the solid cosmetic product before it passes through the orifices, wherein the vault and the means for supporting the vault are configured so that more than about 60% of the inner surface of the vault with respect to its total surface is contacted with the solid cosmetic product before it passes through the orifices; and wherein the solid cosmetic product has a hardness measured at 32° C. under humidity of 40% ranging from about 5 kPa to about 150 kPa.

2. The device according to claim 1, wherein the vault and the means for supporting the vault are configured so that greater than about 75% of the inner surface of the vault with respect to its total surface is contacted with the solid cosmetic product before it passes through the orifices.

3. The device according to claim 2, wherein the vault and the means for supporting the vault are configured so that greater than about 95% of the inner surface of the vault with respect to its total surface is contacted with the solid cosmetic product before it passes through the orifices.

4. The device according to claim 1, wherein the vault and the means for supporting the vault are configured to be in contact with one another only at the periphery of the vault.

5. The device according to claim 1, wherein the first elastically deformable material comprises an elastomer.

6. The device according to claim 5, wherein the second material is able to flex elastically during the application of the product to the skin.

7. The device according to claim 1, wherein the first elastically deformable material and the second material are firmly attached to each other by bi-injection moulding.

8. The device according to claim 1, wherein the outer surface area of the first elastically deformable material comprises more than about 50% of the surface area of the covering means configured to contact the skin.

9. The device according to claim 8, wherein the outer surface area of the first elastically deformable material comprises more than about 75% of the surface area of the covering means configured to contact the skin.

10. The device according to claim 1, wherein the vault has an outward deflection value, under the application of a 500 gram load, ranging from about 0.3 mm to about 3 mm.

11. The device according to claim 10, wherein the vault has an outward deflection value, under the application of a 500 gram load, ranging from about 0.5 mm to about 2.5 mm.

12. The device according to claim 1, wherein the vault has an inward deflection value, under the application of a 500 gram load, ranging from about 1 mm to about 7 mm.

13. The device according to claim 12, wherein the vault has an inward deflection value, under the application of a 500 gram load, ranging from about 2 mm to about 5.5 mm.

14. The device according to claim 1, wherein the surface area of the orifices comprises between about 0.1%A and about 15% of the total surface area of the vault.

15. The device according to claim 14, wherein the surface area of the orifices comprises between about 0.2% and about 10% of the total surface area of the vault.

16. The device according to claim 1, wherein the solid cosmetic product has a hardness measured at 32° C. under humidity of 40% ranging from about 20 kPa to about 100 kPa.

17. The device according to claim 1, wherein the solid cosmetic product comprises at least one component chosen from deodorants, antiperspirant active agents, or both.

18. The device according to claim 1, wherein the solid cosmetic product is anhydrous.

19. The device according to claim 1, wherein the solid cosmetic product is an emulsion.

20. The device according to claim 1, wherein the solid cosmetic product comprises at least one solid fatty substance.

* * * * *